United States Patent [19]

Godwin

[11] 4,137,051

[45] Jan. 30, 1979

[54] GRATE FOR COAL GASIFIER

[75] Inventor: Stanley J. Godwin, Schenectady, N.Y.

[73] Assignee: General Electric Company, Schenectady, N.Y.

[21] Appl. No.: 867,380

[22] Filed: Jan. 6, 1978

[51] Int. Cl.[2] ..... C10J 3/72

[52] U.S. Cl. ..... 48/66; 48/77; 48/87; 48/210; 110/247; 241/185 R

[58] Field of Search ..... 48/66, 68, 85 R, 87, 48/77, 76, 62 R, 197 R, 210; 110/275, 165 R, 247; 241/27, 185 R, 189 R; 126/182; 432/139

[56] References Cited

U.S. PATENT DOCUMENTS

| | | | |
|---|---|---|---|
| 1,406,637 | 2/1922 | George | 48/66 |
| 2,252,802 | 8/1941 | Daniels | 110/165 R |
| 2,823,103 | 2/1958 | Gruber | 48/68 |

*Primary Examiner*—S. Leon Bashore
*Assistant Examiner*—George C. Yeung
*Attorney, Agent, or Firm*—Richard G. Jackson; Joseph T. Cohen; Leo I. MaLossi

[57] ABSTRACT

An improved grate construction for a fixed bed coal gasifier comprises an interrupted generally cylindrical platform including a plurality of sector-like portions and rotatable means, e.g. a stirrer, mounted for rotation adjacent the upper surface of each platform portion. The upper surface of each portion is inclined upwardly in a circumferential direction to an upper leading edge thereof from which an upright wall depends. The stirrer is rotated in the opposite circumferential direction for cooperating with the depending walls to reduce the size of clinkers and for promoting movement of solids from the shaft over the platform.

11 Claims, 4 Drawing Figures

GRATE FOR COAL GASIFIER

BACKGROUND OF THE INVENTION

This invention relates to grate construction for a fixed bed coal gasifier.

In the fixed bed coal gasification process, coal enters the gasifier at the top and lands on top of the charge of coal already in the gasifier where it receives heat from the upwardly-moving product gas. As the combustion process near the bottom of the gasifier (above the grate) consumes some of the coal and the rest of the coal is gasified, coal at the top of the charge gradually moves down, passing through a series of treatment stages: initial heating; devolatilization and coking; gasification, and carbon oxidation. A large number of chemical reactions occur and a minimum temperature of about 1700–1900° F is required. Usually the gasification is conducted under superatmospheric pressure. When air and steam are introduced to the combustion zone, the end product is producer gas; when oxygen and steam are employed, the end product is synthesis gas.

It is well recognized in the coal gasification art that problems in the operation of coal gasifiers often result from large agglomerates or clinkers, which retard the solids flow through the grate and ash collection-and-discharge assembly therebelow. This can shut down the gasifier. Heretofore known grate constructions have been complex, inefficient and expensive and not entirely satisfactory from the standpoint of such solids flow retardation and gasifier shutdowns.

It has now been found by practice of the present invention that clinker problems can be effectively overcome by a grate construction adapted to substantially reduce the size of large solids, e.g. clinkers, received thereon.

DESCRIPTION OF THE INVENTION

Generally stated, the present invention provides an improved grate construction useful for reducing the size of clinkers in a fixed bed coal gasifier. The grate construction comprises (A) a generally cylindrical platform including thereon means in the upper surface thereof for defining generally radially extending notch and (B) means, e.g. a stirrer, rotatable relative to said platform in a plane generally parallel thereto and in register with said notch-defining means to co-act therewith in a scissors-like action.

In a preferred embodiment, the platform includes a plurality of sector-like portions, the upper surfaces of which are inclined upwardly in a single circumferential direction, each from a lower trailing edge thereof to an upper leading edge thereof. The leading edge of each portion is in register with the lower trailing edge of the adjacent portion disposed in the single circumferential direction therefrom. Each portion has a generally upright wall depending from its leading edge toward the trailing edge in register therewith. In operation, the stirrer is rotated in the opposite circumferential direction for cooperating with the depending walls to reduce the size of clinkers and for promoting movement of solids from the shaft over the platform.

Generally stated, in another aspect, this invention provides an improved process for producing a fuel gas from coal. The improvement comprises reducing the size of clinkers contained in the solids on the grate by trapping the clinkers in a notch defined by an upright wall and an inclined surface and simultaneously applying a shearing force to the clinkers to reduce a dimension thereof to a value of not more than the height of the wall above the inclined surface.

BRIEF DESCRIPTION OF THE DRAWING

Practice of the present invention will be better understood by having reference to the following detailed description taken with the accompanying drawing wherein like numerals refer to similar elements throughout and.

DETAILED DESCRIPTION OF THE INVENTION AND MANNER AND PROCESS OF MAKING AND USING IT

Figure 2:
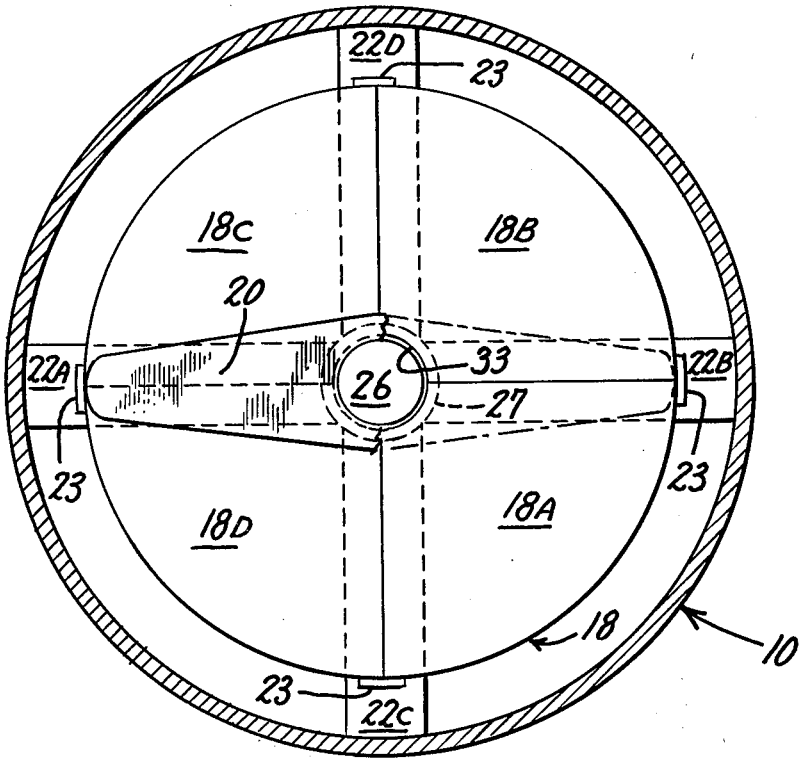
FIG. 2 is a sectional view taken on line 2—2 of FIG. 1.
Figure 1:
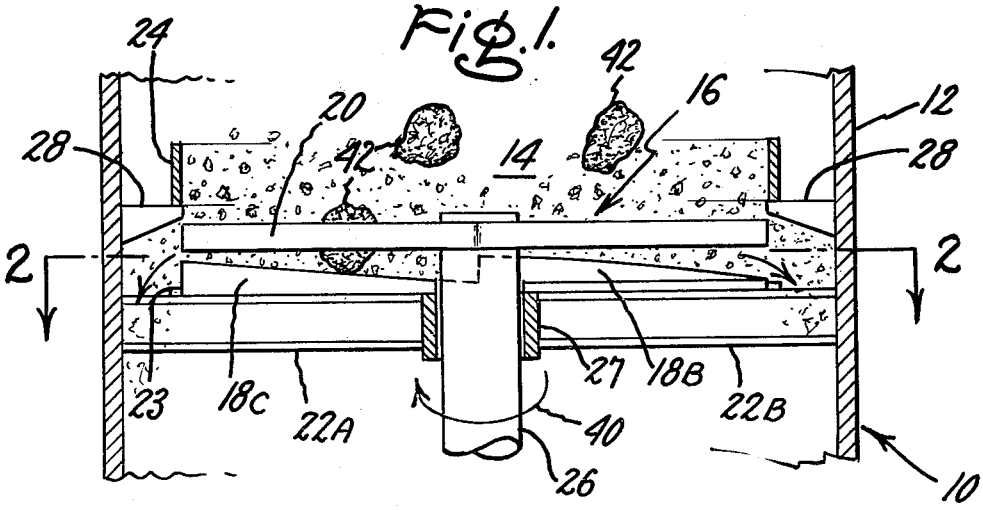
FIG. 1 is an elevation view, partially in section, schematically illustrating a preferred grate construction of the present invention in a coal gasifier.

Referring now to the drawing and particularly FIGS. 1 and 2, there is shown fixed bed coal gasifier 10 having a housing which consists of wall 12, which may be a refractory lining within a metal housing. Alternatively, the wall construction may include a pair of spaced walls which together define a cooling wall jacket. Only the lower portion of the gasifier and coal bed 14 contained therein is shown. The bed 14 is supported preferably by stationary platform 18 included as a component of grate construction or assembly 16 which further includes rotatable means illustrated by rabble arm 20 mounted for rotation adjacent the upper surface of the platform.

Portions of the gasifier which are not illustrated in the present drawing may be of any well known construction, as shown for example, in U.S. Pat. No. 2,440,940 (Galusha), U.S. Pat. No. 3,454,382 (Hamilton), and U.S. Pat. No. 2,803,321 (Junkers).

Figure 3:
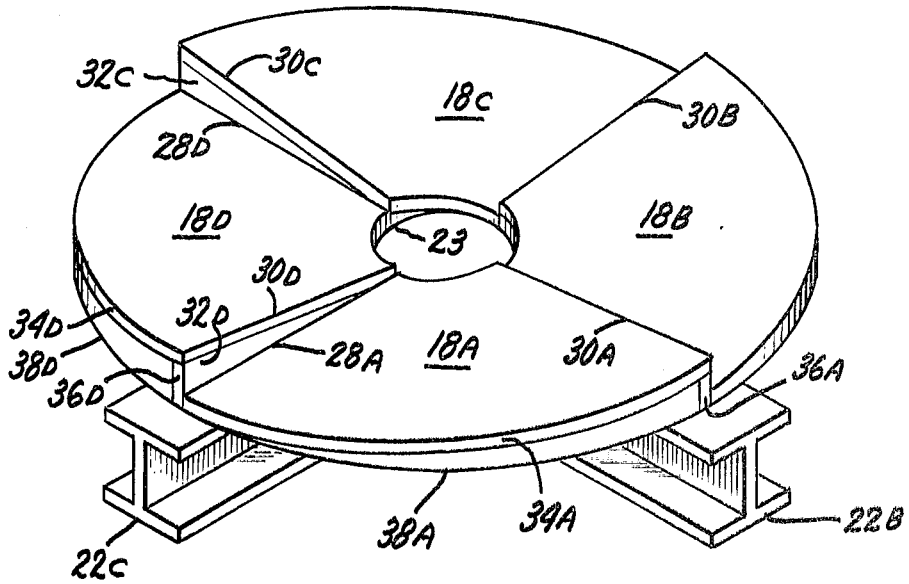
FIG. 3 is a perspective view illustrating in greater detail the platform of the grate construction of FIG. 1.

As best illustrated in FIGS. 2 and 3, the grate platform is of interrupted generally cylindrical shape and includes a plurality of generally concentric sector-like portions 18A, 18B, 18C and 18D. The various platform portions may be supported in any suitable manner, as by support members which may be steel I-beams 22A, 22B, 22C and 22D as illustrated in FIGS. 1 and 2. Radial support for the various platform portions is preferably provided by retainers 23 securely mounted on the I-beams as by welding and in engagement with the peripheral portions of the platform. The I-beams may be supported by a suitable means, e.g. by welds (not shown) securing the I-beams to the wall 12.

As best illustrated in FIG. 3, the upper surface of each platform portion is inclined upwardly in a single circumferential direction (counter-clockwise in FIG. 3) from a lower trailing edge 28 thereof to an upper leading edge 30 thereof. For example, platform portion 18A is so inclined from lower trailing edge 28A to upper leading edge 30A. These leading and trailing edges preferably extend generally radially of the platform as illustrated.

Each leading edge 30 (i.e. 30A, 30B, 30C and 30D) is in register with the lower trailing edge 28 (i.e. 28A, 28B, 28C and 28D) of its respective preceding adjacent portion. Such register relationship is illustrated by substantially vertical alignment of, for example, leading edge 30D of platform section 18D with trailing edge 28A of platform portion 18A, which, as shown, is adjacent to platform section 18D and disposed in the single circumferential direction (i.e. counterclockwise) therefrom. Platform portion 18C has generally upright wall 32C depending from its leading edge 30C toward, and preferably to, trailing edge 28D in register therewith (FIG. 3). In like manner platform portion 18D has generally upright wall 32D depending from leading edge 30D toward, and preferably to, the trailing edge 28A in register therewith. In like manner, like upright walls (hidden from view in FIG. 3) depend from leading edges 30A and 30B toward, and preferably to the trailing edges (also hidden from view in FIG. 3) of platform portions 18B and 18C, respectively.

Figure 4:
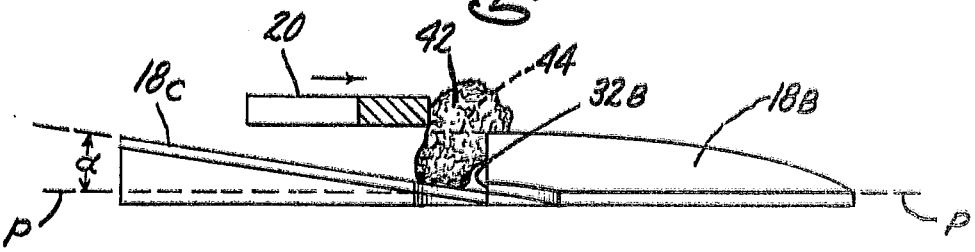
FIG. 4 is an elevation view, partially in section, schematically illustrating cooperation of the stirrer with the platform components of the grate construction in reducing the size of a clinker.

The upper surfaces of the various platform portions may be of any suitable shape, preferably generally planar as illustrated. Such platform portions conveniently may be formed of generally flat sector-like plates 34 (e.g. plate 34A of platform portion 18A), wherein each plate is rotated about its radial trailing edge 28 such that its radial or leading edge 30 is inclined at a small angle, e.g. from about 0.1 to about 10° from the plane containing the various trailing edges. In FIG. 4, such angle is represented by angle $\alpha$ and such plane is indicated by broken line P.

In the illustrated preferred embodiment, the sector-like portions are 4 in number, with each portion subtended by an angle of about 90°, i.e. each portion is generally in the shape of a quadrant of a circle. When the platform portions are formed of plates 34 as described above, each wall 32 (e.g. wall 32D in FIG. 3) is preferably defined by the thickness of the plate at the upper or leading edge thereof (e.g. edge 30D) together with the radially extending face of generally triangular shim 36, illustrated by shims 36A and 36D for plates 34A and 34D respectively. The shims 36 may be welded or otherwise secured to the undersurface of their respective plates and preferably are secured to the I-beams, as by welds, for preventing rotation of the plates. Any suitable means may be employed to retain the platform in a stationary mode. Peripheral supports 38 illustrated by supports 38A and 38D may additionally be welded to the undersurfaces of the plates, e.g. plates 34A and 34D, respectively.

Rabble arm or stirrer 20 is centrally located with its rotatable shaft 26 extending upwardly through bushing or clearance ring 27 carried by the I-beams and through hole 33 defined by radially inner surfaces of the platform portions. The rabble arm is adapted for both rotational and vertical movement for the raising and lowering thereof to facilitate operation in two modes. When in the lower position (illustrated in FIGS. 1 and 4), rotation of the rabble arm promotes discharge of ash from the outer periphery of the platform to an ash collection-and-discharge assembly (not shown) therebelow. Such discharge is at a rate fixed by the rate of rotation of the rabble arm. In the raised position, the rabble arm can be used to agitate the bed under the combustion zone. For example, the shaft may be raised to an extent such that the rabble arm is within optionally included Bosh ring 24 supported by supports 28, which in turn are supported by wall 12 using any suitable fastening means, e.g. welding where weldable materials are employed.

The air/steam or oxygen/steam input (not shown) to the gasifier may be pre-mixed as it enters the plenum under the grate or may be introduced into the plenum as separate flows. The gases so admitted move upwardly through the grate construction and its cover of ash or other solids for movement into bed 14.

As illustrated in FIGS. 1 and 4, when the rabble arm is in its lower position, it rotates adjacent the upper surface of each platform portion in the direction of arrow 40 (FIG. 1), which direction is an opposite circumferential direction relative to the direction of inclination of the upper surface of each platform portion as described above. FIG. 4 schematically illustrates cooperation of rotating rabble arm 20 (shown in partial section) with depending wall 32B to reduce the size of large agglomerate or clinker 42. As the rabble arm rotates, clinkers such as clinker 42 encountered on the platform are moved by the rabble arm to the nearest upright wall, such as upright wall 32B, in which location the clinkers are trapped or temporarily held in the notch or open recess defined by the upright wall and the inclined surface of the platform portion. As the rabble arm is further rotated, the arm and upright wall cooperate to apply a shearing force to the clinker to effect reduction of the vertical dimension thereof to a value generally equal to the height of the wall above the inclined surface. Such shearing force results in shearing the clinker, e.g. along a plane illustrated by broken line 44 in FIG. 4. Advantageously, such cooperative action of the rabble arm and upright walls provide a scissors-like action, whereby not only are clinkers reduced in size as by severence thereof, but also the clinkers are moved generally radially outwardly along the upright wall while the shearing action is being effected. Thus, the resulting residue of the severed clinkers may be discharged over the periphery of the platform.

The platform may be of any suitable dimensions. For example, the outer diameter of the platform may be about 45 inches with a through-hole of about 4.5 inches in diameter and heights of the upper edges above the I-beams of about 3 inches. A rabble arm having a total longitudinal extent approximately equal to the diameter of the platform is generally preferred.

Grate parts, the rabble arm, the supporting shaft therefor, as well as the various other supports or supporting members may be conveniently formed of cast steel. The upright walls of the platform portions and the edges of the rabble arm are preferably hard surfaced with weld layed stellite.

BEST MODE CONTEMPLATED

The best mode contemplated for carrying out this invention has been set forth in the description above, for example, by way of setting forth preferred structural arrangements and materials of construction and other unobvious variables material to successfully practicing (including making and using) the invention in the best way contemplated at the time of executing this patent application.

It is understood that the foregoing detailed description is given merely by way of illustration and that many modifications may be made therein without departing from the spirit or scope of the present invention.

What is claimed is:

1. In an apparatus for producing a fuel gas from coal including a shaft disposed over an enclosed grate assembly whereby coal moving by gravity down said shaft is subjected first to carbonization and then to reduction, the improvement for reducing the size of clinkers wherein said grate assembly comprises, in combination:

(A) a generally cylindrical platform including means in the upper surface thereof for defining a generally radially extending notch therein and (B) means rotatable relative to said platform in a plane generally parallel thereto and in register with said notch-defining means to co-act therewith in a scissors-like action.

2. The apparatus of claim 1 wherein:

(A) said platform includes a plurality of sector-like portions, the upper surfaces of the portions being inclined upwardly in a single circumferential direction, each portion extending from a lower trailing edge thereof to an upper leading edge thereof, the leading edge of each portion being in register with the lower trailing edge of the adjacent portion disposed in said single circumferential direction therefrom, each portion having one of the generally upright walls depending from its leading edge toward the trailing edge in register therewith to form one of said notches with the inclined surface extending from the last-mentioned trailing edge, and (B) said rotatable means is mounted for rotation adjacent the upper surface of each platform portion in the opposite circumferential direction for cooperating with the depending walls to reduce the size of clinkers and for promoting movement of solids from said shaft over said platform.

3. The improvement of claim 2 wherein said leading and trailing edges extend generally radially of the platform.

4. The improvement of claim 1 wherein said platform is stationary.

5. The improvement of claim 2 wherein said platform portions are generally annular and radially inner surfaces thereof define a hole through which a rotatable shaft of said rotatable means extends.

6. The improvement of claim 2 wherein the upper surfaces of said portions are generally planar.

7. The improvement of claim 6 wherein each platform portion includes a generally flat sector-like plate rotated about a first radial edge defining the trailing edge such that the opposite radial edge defining the leading edge is inclined at an angle of from about 0.1 to about 10° from the plane containing the trailing edges.

8. The improvement of claim 7 wherein the sector-like portions are four in number, each portion subtended by an angle of about 90°.

9. In a process for producing a fuel gas from coal by subjecting the coal to carbonization and then to reduction as it moves by gravity down a shaft, with the solids remaining at the lower end of said shaft being removed from the gasification process by passage through a grate structure including a platform, the improvement comprising the step of: reducing the size of clinkers contained in the solids on the platform by trapping the clinkers in a notch defined in the upper surface of said platform by a generally upright wall and an inclined surface thereof and simultaneously applying a shearing force to the clinkers by rotating an arm relative to said notch in cooperation with said upright wall to effect size reduction of the trapped clinkers in a vertical dimension thereof to a value of not more than the height of the wall above the inclined surface.

10. The apparatus of claim 1, wherein said notch-defining means includes a generally upright wall and an inclined surface of the platform.

11. The apparatus of claim 10, wherein said platform includes a plurality of said notch-defining means with the corresponding plurality of generally radially extending notches being circumferentially spaced apart.

* * * * *